US007546880B2

(12) United States Patent
Zhang et al.

(10) Patent No.: US 7,546,880 B2
(45) Date of Patent: Jun. 16, 2009

(54) EXTRACTING GAS HYDRATES FROM MARINE SEDIMENTS

(75) Inventors: Hong-Quan Zhang, Tulsa, OK (US); James P. Brill, Tulsa, OK (US); Cem Sarica, Broken Arrow, OK (US)

(73) Assignee: The University of Tulsa, Tulsa, OK (US)

( * ) Notice: Subject to any disclaimer, the term of this patent is extended or adjusted under 35 U.S.C. 154(b) by 149 days.

(21) Appl. No.: 11/609,734

(22) Filed: Dec. 12, 2006

(65) Prior Publication Data

US 2008/0135257 A1 Jun. 12, 2008

(51) Int. Cl.
*E21B 7/15* (2006.01)

(52) U.S. Cl. ..... 166/358; 166/302; 166/369; 166/60; 175/16; 175/17; 405/131; 299/8

(58) Field of Classification Search ..... 166/358, 166/302, 369, 366, 267, 52, 356, 272.1, 60; 175/5, 16, 17; 405/131
See application file for complete search history.

(56) References Cited

U.S. PATENT DOCUMENTS 4,007,787 A 2/1977 Cottle
4,376,462 A 3/1983 Elliott et al.
4,424,858 A 1/1984 Elliott et al.
5,060,287 A * 10/1991 Van Egmond ..... 392/301
5,179,793 A 1/1993 Rohr
5,713,416 A 2/1998 Chatterji et al.
5,950,732 A 9/1999 Agee et al.
5,964,093 A 10/1999 Heinemann et al.
6,035,933 A 3/2000 Khalil et al.
6,046,685 A * 4/2000 Tubel ..... 340/853.2
6,148,911 A 11/2000 Gipson et al.
6,192,691 B1 * 2/2001 Nohmura ..... 62/53.1
6,209,965 B1 * 4/2001 Borns et al. ..... 299/8
6,214,175 B1 4/2001 Heinemann et al.
6,299,256 B1 * 10/2001 Wyatt ..... 299/8
6,604,580 B2 8/2003 Zupanick et al.
6,679,326 B2 1/2004 Zakiewicz
6,817,427 B2 * 11/2004 Matsuo et al. ..... 175/67
6,973,968 B2 12/2005 Pfefferie
6,978,837 B2 * 12/2005 Yemington ..... 166/303

(Continued)

FOREIGN PATENT DOCUMENTS

JP 6025021 1/1993

(Continued)

*Primary Examiner*—Thomas A Beach
*Assistant Examiner*—Matthew R Buck
(74) *Attorney, Agent, or Firm*—Head, Johnson & Kachigian

(57) ABSTRACT

A process for extracting hydrocarbon gases from marine sediment hydrates. In one embodiment, the process includes drilling from a sea floor into a hydrate rich subsea sediment to form at least one opening therein. Electrical heaters are inserted into the opening or openings. The hydrate rich subsea sediment is heated with the electrical heaters in order to release hydrocarbon gas therefrom. The released hydrocarbon gas is collected in an overhead receiver. The hydrocarbon gas forms hydrates again when moving through the cold sea water and inside the overhead receiver. The overhead receiver is raised to a sea depth where pressure and temperature permit the hydrates to dissociate and to release the hydrocarbon gas. The hydrocarbon gas is then gathered from the top of the overhead receiver.

6 Claims, 7 Drawing Sheets

U.S. PATENT DOCUMENTS

| | | | | |
|---|---|---|---|---|
| 6,994,159 | B2 | 2/2006 | Wendland | |
| 7,008,544 | B2 * | 3/2006 | Max | 210/708 |
| 7,185,705 | B2 * | 3/2007 | Fontana | 166/356 |
| 2002/0169345 | A1 | 11/2002 | Johnson | |
| 2004/0244227 | A1 * | 12/2004 | Baciu | 37/195 |
| 2005/0016725 | A1 | 1/2005 | Pfefferie | |
| 2005/0284628 | A1 | 12/2005 | Pfefferie | |
| 2006/0113079 | A1 * | 6/2006 | Yemington | 166/302 |

FOREIGN PATENT DOCUMENTS

| | | |
|---|---|---|
| JP | 10317869 | 12/1998 |
| JP | 2003082975 | 3/2003 |
| JP | 2004204562 | 7/2004 |
| JP | 2004321952 | 11/2004 |
| JP | 2005139825 | 6/2005 |
| RU | 1792482 | 1/1993 |
| WO | WO03021079 | 3/2003 |

* cited by examiner

EXTRACTING GAS HYDRATES FROM MARINE SEDIMENTS

BACKGROUND OF THE INVENTION

1. Field of the Invention

The present invention is directed to a process for extracting hydrocarbon gases from suboceanic marine sediment hydrates. In one embodiment, hydrate rich sediments are drilled and then electrically heated to release hydrocarbon gases with subsequent capture in an overhead receiver. The overhead receiver is raised to a sea depth to permit dissociation of the hydrocarbon gases which are then gathered. In another embodiment, subsea marine sediments containing hydrates are partitioned, and loaded into a container. The container is covered with an overhead receiver and is raised to a shallower sea depth wherein lower pressure and higher temperature permit hydrocarbon gas to be released and gathered.

2. Prior Art

The present invention provides a process to harvest gas hydrates from marine sediments located between the sea floor and the hydrate base line in order to extract hydrocarbon gases.

Gas hydrates are ice-like crystalline solids formed from a mixture of water, methane, and other hydrocarbon gases. They can occur in the pore spaces of marine sediments and can form cements, nodes or layers.

It is known that seawater (hydrothermal) temperature decreases from the sea surface to the sea floor. It is also known that the earth temperature increases beneath the sea floor due to the local geothermal gradient. On the other hand, the hydrate formation temperature ("HFT") corresponding to the phase boundary increases due to the increase of the hydrostatic pressure.

FIG. 1 illustrates an example of a known subsea temperature profile with depth below the surface of the sea charted against the temperature in ° K. The dashed line having reference numeral 10 illustrates a temperature of 273° K or 0° C., the freezing temperature of fresh water. The dashed line with reference numeral 12 illustrates an example of the temperature of sea water at different subsurface depths. The straight line having reference numeral 14 illustrates an example of the depth of the sea water with sea water above and sediment below. The parallel dashed line 16 illustrates the base of the hydrate depth. Below the dashed line 16, it is generally too warm for solid hydrates to form. It can be seen that the temperature is the lowest at the sea floor. The arched line 18 illustrates the phase boundary between hydrate solids and water/gases with hydrate solids to the left and water and gases to the right of line 18.

As illustrated by dashed line 12, below the sea floor, the temperature rises again with a certain geothermal gradient. When the water depths exceed 300 to 500 meters, gas hydrates are stable in a zone from the sea floor to the hydrate baseline where the temperature is equal to the HFT. This zone is called the Hydrate Stability Zone (HSZ). The heat needed to melt the hydrates in the region close to the hydrate baseline is relatively small.

According to the US Geological Survey, gas hydrates bind immense amounts of methane and other hydrocarbon gases in sea-floor sediments. Natural conditions exist suitable for the formation of hydrocarbon bearing hydrates in a subsea layer covering much of the earth. If produced cost effectively, they could serve as a stable energy supply. At least three methods have been proposed in the past for hydrocarbon gas production from hydrates, including thermal injection, depressurization, and hydrate inhibitor injection.

Examples of prior art proposals include:

Elliot et al. (U.S. Pat. No. 4,376,462) which discloses pumping relatively warm brine water down to hydrates in the sea bed through a conduit, allowing the brine to circulate through the hydrates to melt and produce gaseous hydrocarbons, and then separating gaseous hydrocarbons from the spent brine.

Satoru et al. (Japanese Publication No. JP2005139825) which discloses in an abstract the use of warm water which is fed to hydrates to gasify and a subsequent recovery mechanism.

Russian Patent Abstract (SU1792482) which discloses a drilling rig lowered to the sea bed with a drilling tube which is connected to a heated drum 8. A dome-shaped folded element is opened, the hydrates are partially decomposed and then transferred by internal pressure into a heated drum for further processing.

Michihiro et a. (Japanese Publication No. 2004204562) discloses in an abstract a subsea boring device 11 to drill a plurality of horizontal wells 30 into a gas hydrate layer 2. Warm heat is sent into the layer 2 in order to decompose the gas hydrates.

The Pfefferie references (U.S. Pat. No. 6,973,968, U.S. Patent Publication No. 2005/0016725 and U.S. Patent Publication No. 2005/0284628) disclose injecting combination products containing carbon dioxide into a hydrate deposit into a well drilled in the sea bed for combustion in order to produce a heated fluid.

German PCT Application WO2003/021079 provides an abstract which discloses introducing fluid from the surface which destabilizes gas hydrates to release gases which are drawn off to above the surface of a riser.

Cottle (U.S. Pat. No. 4,007,787) discloses injection of normally liquid light hydrocarbons into a hydrate reservoir in order to disclose hydrates with optional injection of a freezing point depressant.

Chatterji et al. (U.S. Pat. No. 5,713,416) discloses injecting and combining an acidic liquid with a basic liquid to form an exothermic reaction producing a hot salt solution to thermally decompose gas hydrates which are produced out of the formation.

Heinemann et al. (U.S. Pat. No. 5,964,093) discloses a sunlight permeable top for a gas hydrate storage cavity.

Heinemann et al. (U.S. Pat. No. 6,214,175) discloses in FIG. 3 a downhole microwave generator which applies electromagnetic radiation to disassociate hydrates in order to release gases.

Nohmura (U.S. Pat. No. 6,192,691) discloses a flexible sheet 2 which is sunk to the sea floor to trap methane hydrate gas which is filled up by the buoyancy of the gasified methane.

Wyatt (U.S. Pat. No. 6,299,256) discloses a flexible cover 10 with steerable pods 12 with a mining module 14 connected to an inside surface of the cover 10 to dislodge deposits by mechanically agitating and/or heating and thawing.

No viable technologies, however, for extracting gas hydrates from deep ocean deposits have been developed to date.

Due to the shallow depths and low permeability of the HSZ, low productivity is anticipated for normal gas production from gas hydrates in marine sediments. Therefore, only a large number of low cost wells could support an offshore production facility and pipeline transport to shore. A way of harvesting natural gas from sea floor gas hydrates presented in the present invention is a combination of new concepts aimed at overcoming technical barriers, maintaining cost and energy efficiencies, and minimizing safety and environmental concerns.

Accordingly, it is a principal object and purpose of the present invention to provide a process to harvest gas hydrates from marine sediments located between the sea floor and the hydrate base line.

It is a further object and purpose of the invention to provide a method to harvest gas hydrates using the nature of the hydrates and subsea pressure and temperature profiles to provide a simple and open production system which is generally safe, economical, energy efficient and environmentally friendly.

SUMMARY OF THE INVENTION

The present invention is directed to harvesting gas hydrates from marine sediments located between the sea floor and the hydrate baseline in order to release and collect hydrocarbon gases.

In one preferred embodiment of the present invention, electrical heaters are inserted into holes drilled into the hydrate rich sediments. The electrical heaters are connected through cables to an electrical power supply.

The electrical heaters warm up the hydrate rich sediments in order to release hydrocarbon gases therefrom. The released gases flow upward due to buoyancy out of the hydrate rich sediments and into the seawater where they are captured by an overhead receiver initially filled with seawater. The hydrocarbon gases may re-form into hydrates as the gas moves through the cold seawater. Since the hydrates are less dense than sea water, they will float to the top of the overhead receiver and will be accumulated therein. The overhead receiver, which is tethered by cables to a vessel, will be raised to a shallower depth so that the temperature increases and the pressure decreases, which causes the hydrates to dissociate, releasing again the hydrocarbon gases. Thereafter, the hydrocarbon gases at the top of the overhead receiver may be drawn off through a pipeline, tube or other fluid line and delivered to the vessel for further processing and transportation.

DETAILED DESCRIPTION OF THE PREFERRED EMBODIMENTS

Figure 1:
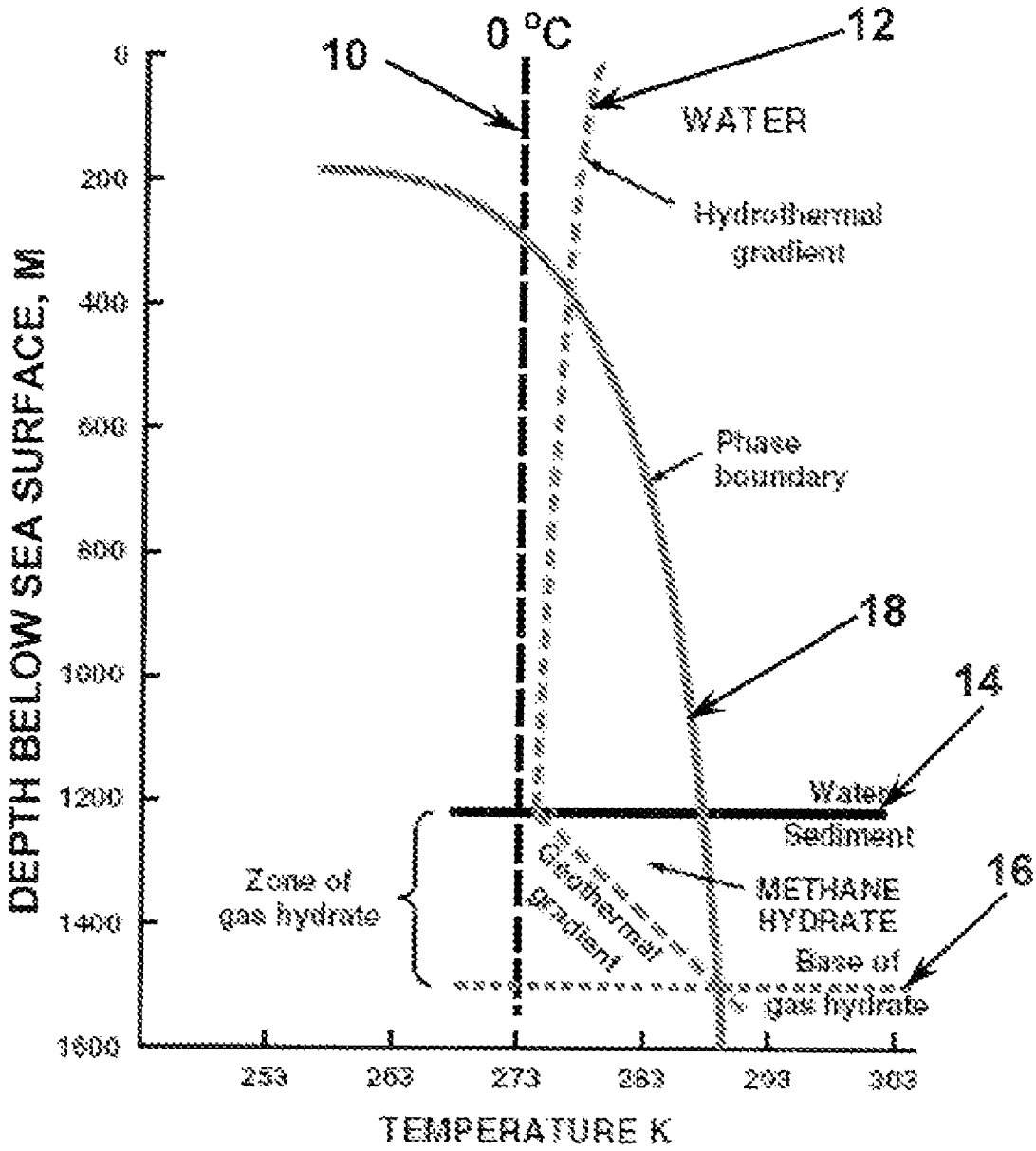
FIG. 1 is a chart illustrating an example of a known subsea temperature profile charted against the depth below the surface of the sea.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Referring to the drawings in detail, FIGS. 2 through 5 illustrate diagrammatic views of one preferred process in accordance with the present invention.

It is known that hydrates are approximately 10% lighter than seawater. Once released from sea floor sediments, hydrocarbon gases or re-formed hydrate particles move upward in still seawater due to buoyancy. Hydrocarbon gases may be released from a well with a casing 30 drilled for this or other purposes. The released free gases or re-formed hydrate particles are captured with an overhead receiver 20 and shown in FIG. 2. The overhead receiver 20 can be any shape and size, and can be made of any material. The overhead receiver 20 may be fabricated from a flexible plastic or fabric or may be light metal. It can be shaped as a canopy with a wide opening at the bottom or can be like a hot-air balloon with a small opening at the bottom. The overhead receiver may be tethered to weights 22. The overhead receiver 20 will be lowered from the surface by lifting cables 24 which may extend from a vessel (not shown) at the surface.

The overhead receiver 20 will fill with seawater and be lowered until the weights rest on the seafloor 32. A well may be drilled into the hydrate zone. As hydrocarbon gases move from the hydrate zone, they form hydrates again when moving into and through the cold seawater or inside the overhead receiver if the temperature is kept below the HFT. The overhead receiver 20 can be used to capture (1) produced hydrate particles or gases, (2) hydrate particles or gases released from drilling, cutting or any other operations, and (3) seeped gases from sea floor vents.

A pipe connection and a valve 34 may be provided at the top of the overhead receiver 20. The valve may be opened when lowering the overhead receiver 20.

Optional supports 38 may be suspended from the overhead receiver 20 which will engage the sea floor 32 to help stabilize the receiver 20.

Figure 3:
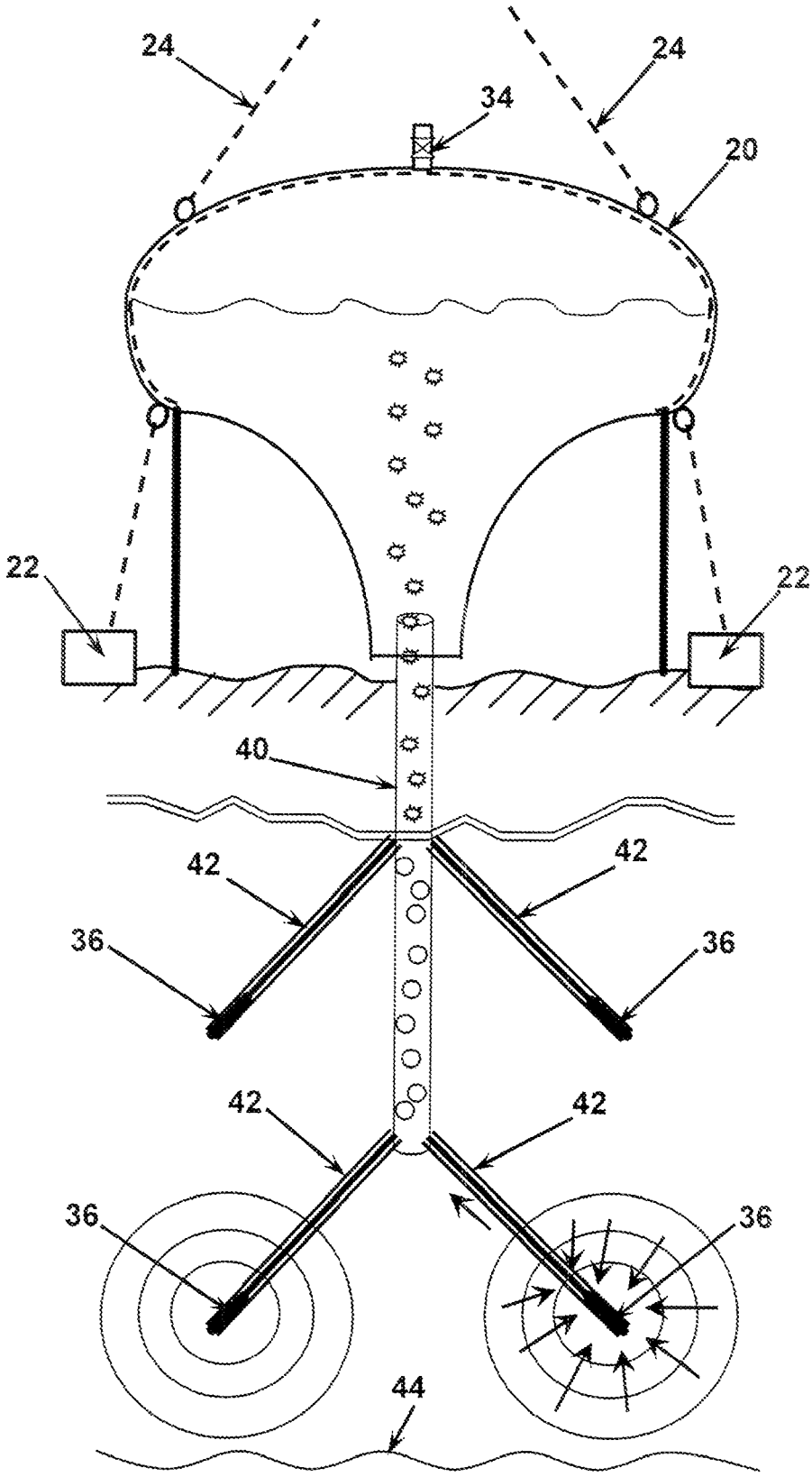

A further variation of this process is shown in FIG. 3. First, a relatively large diameter well 40 is drilled from the sea floor 32 to near the hydrate baseline 44. The well diameter has to be large enough to allow drilling of smaller radial holes 42 as shown in FIG. 3. Electrical heaters 36 can be inserted into the small holes to warm up the hydrate rich sediments to release gases. The small diameter radial holes 42 can be drilled with an appropriate angle to allow the released gas to flow into the large well 40. The released gas flows upward due to buoyancy in the large diameter well and is captured by the overhead receiver above the outlet. Hydrates will form again when the gases move through the cold seawater or inside the receiver 20. The production rate can be controlled by the heating rate of the electrical heaters. Optionally, the wall of the large diameter well may need to be insulated or warmed up to prevent hydrate deposition or to release hydrate deposits periodically. A pump (not shown) may optionally be needed to lower the downhole pressure in order to accelerate the dissociation process.

In one non-limiting example of an application of the present invention, a large diameter well, such as a six inch (6") hole diameter well, will be drilled from the sea floor to near the hydrate baseline, for example, a thousand feet below the sea floor. The well may be a simple opening or may need completion and installation services as are well known in the drilling industry field. Thereafter, a plurality of two inch radial holes will be drilled at a downward angle, for example 30° to approximately 150 foot distance periodically along the large diameter well in order to produce gas hydrates within a diameter of approximately 500 feet.

Thereafter, electrical resistance heaters 36 will be inserted into the smaller two inch radial holes. The electrical resistance heaters may extend from electrical lines extending from a vessel at the sea surface containing an electrical generator. The electricity may alternately be provided with a subsea transmission line connected to an onshore electrical power network. The electrical resistance heaters 36 will warm the formation by electrical heating. This will cause the hydrates to melt as the temperature of the sediments is increased to a point above the hydrate formation temperature thereby releasing hydrocarbon gases form the hydrates.

The hydrocarbon gases will flow through the smaller two inch radial holes to the six inch large well. With the overhead receiver 20 in place, the gases will flow into the overhead receiver. Because the temperatures of the seawater within the overhead receiver is low and the pressure is high, the gas will re-form into hydrates inside the overhead receiver. The hydrates will float to the top due to buoyancy and will be accumulated in the overhead receiver 20. One cubic foot of hydrates contain about 170 standard cubic feet (scf) of natural gas. For example, a $60^3$ cubic foot overhead receiver would store about 40 million scf of natural gas. Assuming a 10% hydrate concentration in the marine sediments, a well across a thousand foot depth layer and a 250 foot radius of influence could produce about 20 million cubic feet of hydrates to produce about 3.4 billion scf of natural gas. Once the overhead receiver is filled with hydrates, the overhead receiver 20 will be lifted to shallower water where the pressure is less and the temperature is higher which is suitable for hydrate dissociation. The dissociation rate and be controlled with the sea depth of the receiver 20. The gases released from the hydrates will be collected from the top of the receiver through a vent and a valve 34 and delivered via a short line 46 to the floating vessel for transportation.

The gases may be compressed on the floating vessel for further transportation. The process can be repeated with other overhead receivers 20 brought into place for nearly continuous production. Assuming a conservative forecast of an average of 18° F. increase in temperature within the marine sediment zone, and melting the hydrates which are assumed 10% concentration in the sediments, the heat needed will be about 13% of the heat value that is produced from the hydrocarbon gases recovered. Assuming an electrical heating rate of 16,000 kilowatts, 10 million scf of natural gas could be produced each day.

After depletion, the electrical heaters 36 can be pulled out of the smaller holes and used again in another open-hole production. Finally, after operations are complete, the large diameter well can be plugged with cement to prevent land sliding.

It is known that free gas and even oil can exist below the hydrate baseline. These hydrocarbon fluids will often be depleted first using conventional production technology before producing gases from the hydrates. After the reservoirs below the hydrate baseline are depleted, the tubing and casing can be pulled out and the wellbore can be cemented closed at the hydrate baseline to prevent possible gas blowout. Then, the borehole can be reamed to a larger diameter to produce gases form the hydrocarbon as described above.

A check vale at the well head may be needed to restrict the heat exchange between the inside of the well and the environment.

Figure 4:
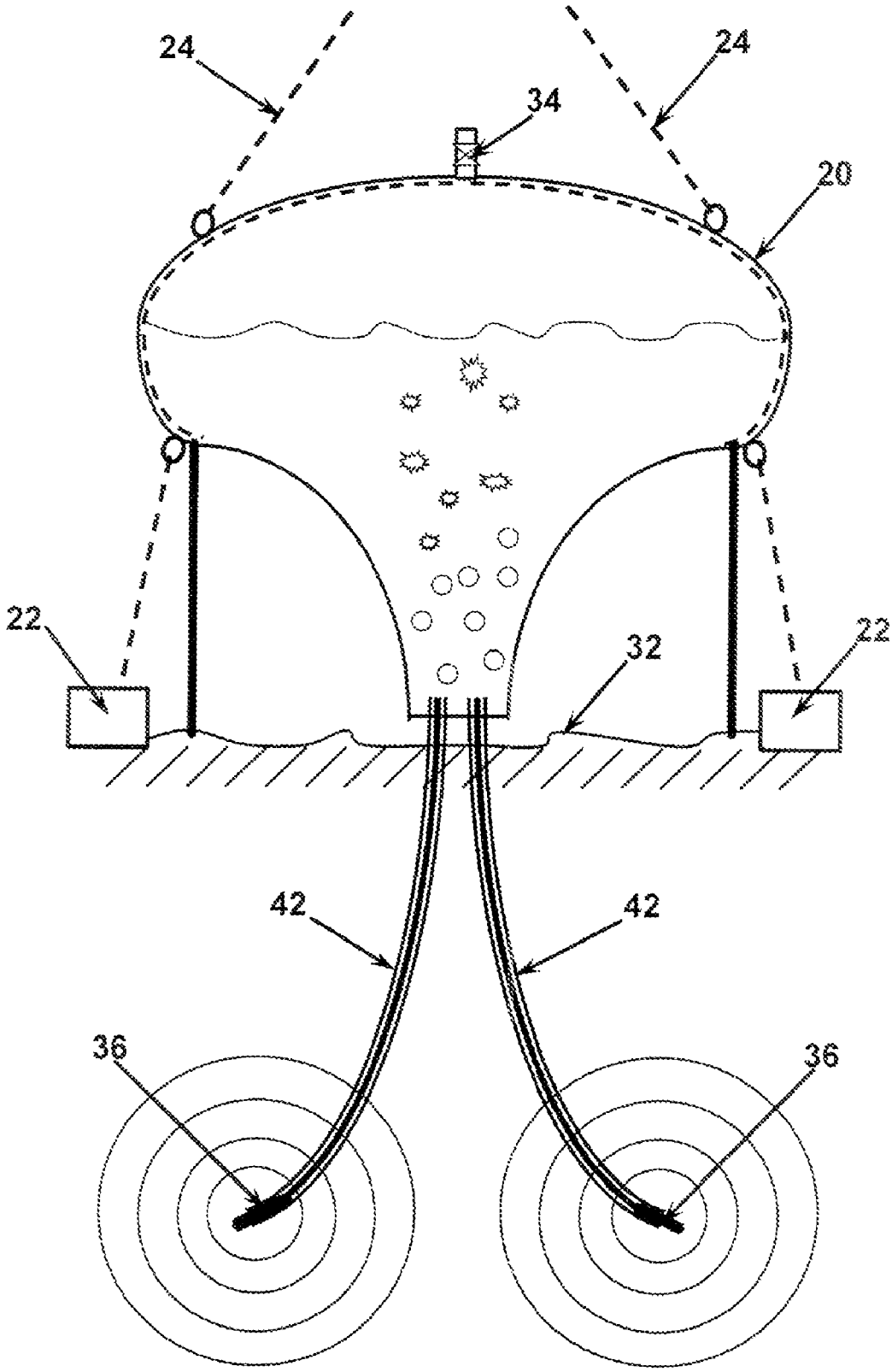

In a further variation of this process shown in FIG. 4, small diameter holes 42 can also be drilled directly from the sea floor 32 to the hydrate rich sediments. Then, the electrical heaters 36 are inserted to warm up sediments to above the HFT. The released gases flow out through the small holes 42 and are captured by the overhead receiver 20 as shown in FIG. 4. The gas will form hydrates again when moving through the cold seawater and inside the overhead receiver 20.

In order to release the gases from hydrates, heat is needed to warm up the sediments to the HFT and to provide the hydrate melting latent heat. Because of the poor permeability and low thermal conductivity of the sediments, electrical heating from inside the sediments seems to be the most efficient and convenient approach. The hydrates within the HFT contour are melted and the released gas flows out through the small diameter holes. The released gas is unlikely to flow outside the HFT contour for two reasons: (1) The hydrate sediments are non-permeable; (2) Gas and water beyond the HFT line will form hydrates again and seal the path.

Figure 2:
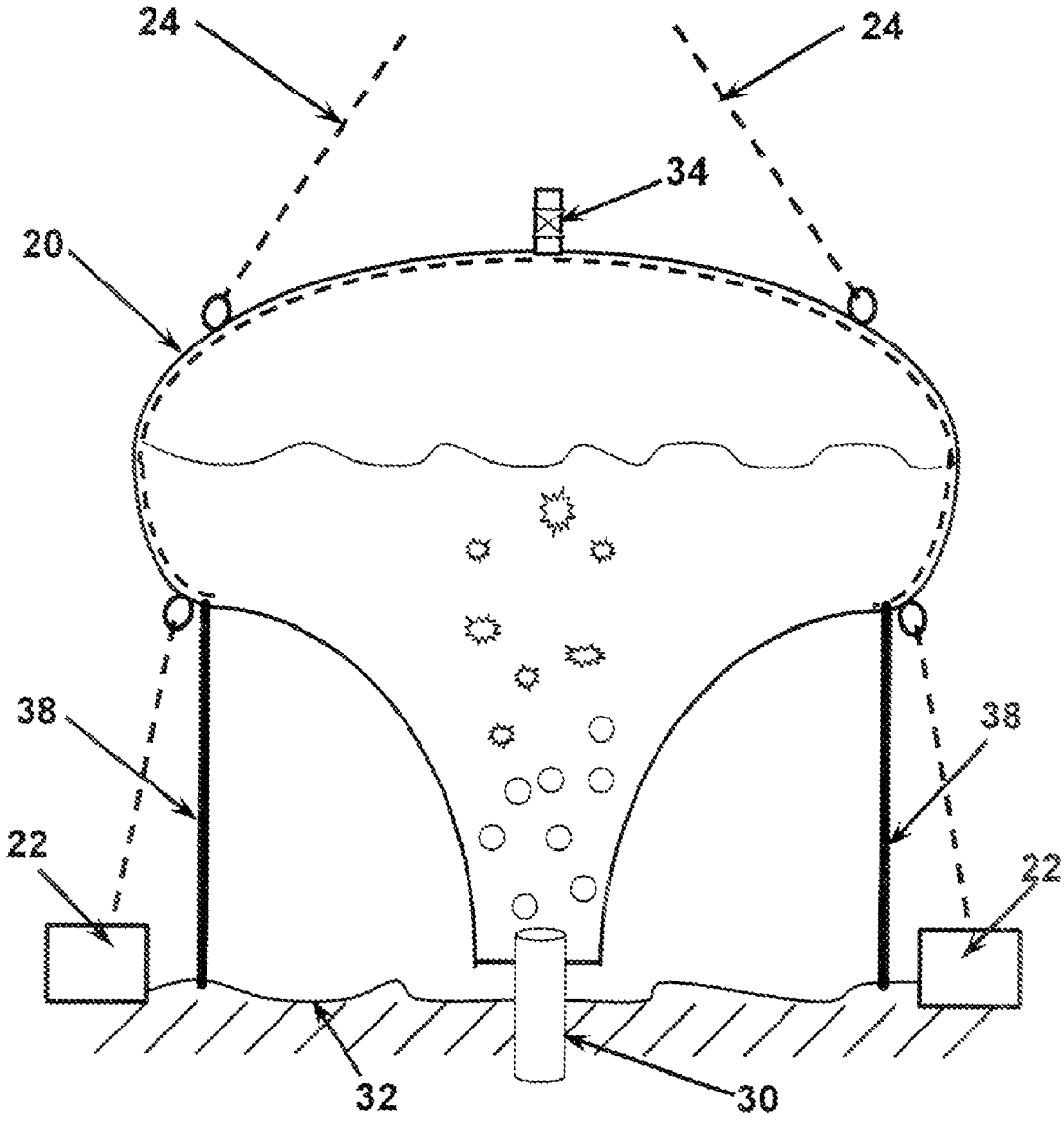
FIGS. 2 through 5 illustrate diagrammatic views of one preferred embodiment of the present invention.
Figure 5:
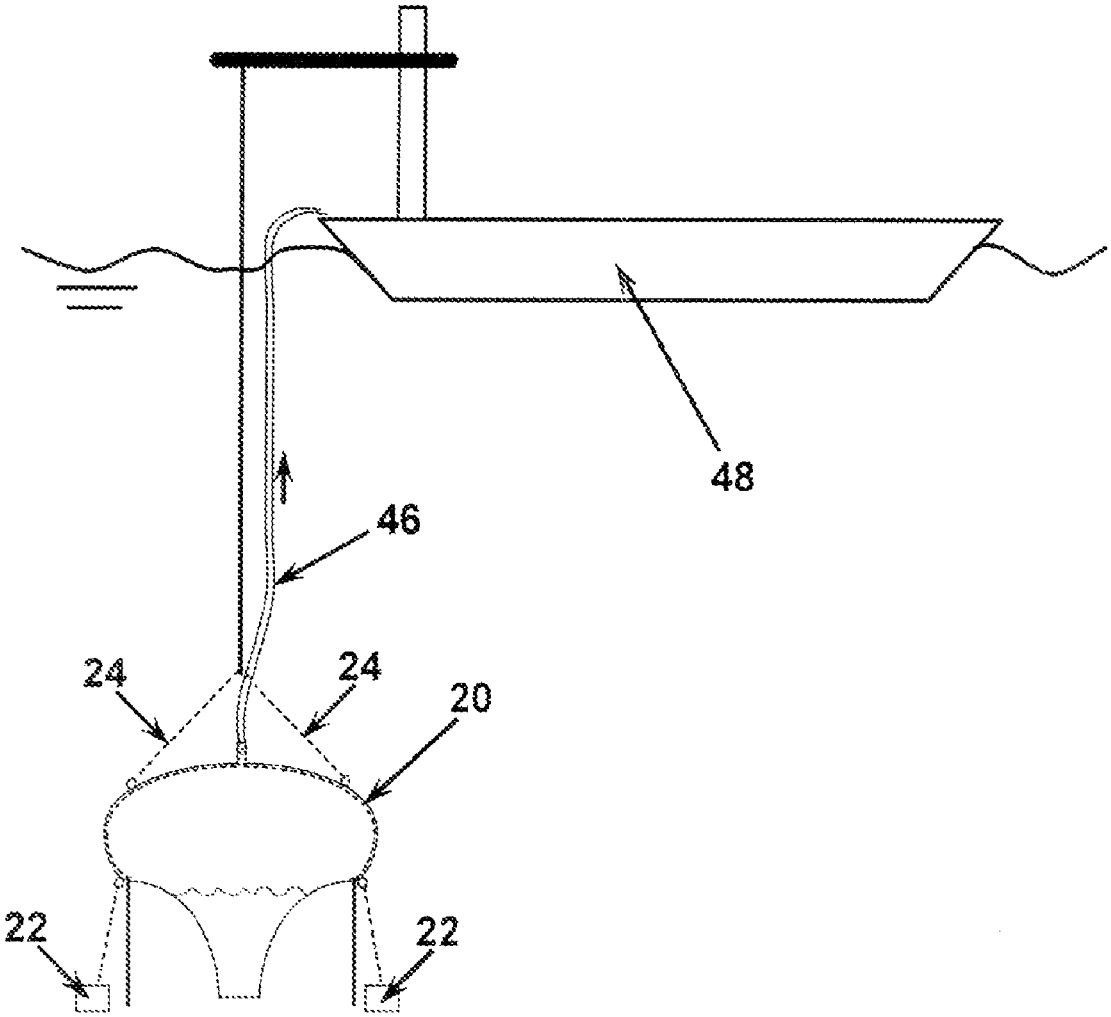

In any of the variations shown in FIG. 2, 3 or 4, when a certain amount of hydrates are accumulated in the overhead receiver 20, it can be lifted up to warmer seawater as shown in FIG. 5. Hydrates will dissociate when the temperature is above the HFT. Gases can flow from the top of the receiver 20 through a fluid line 46 to a floating vessel 48. Then, the gas can be compressed and transported to shore. One floating vessel 48 can take care of the production from many harvesting sites. The produced hydrates can also be conveniently stored and transported in deepwater rather than raising them to shallower depths where they will dissociate. The inside structures of the overhead receiver 20 can be designed to ensure heat exchange with seawater.

Figure 6:
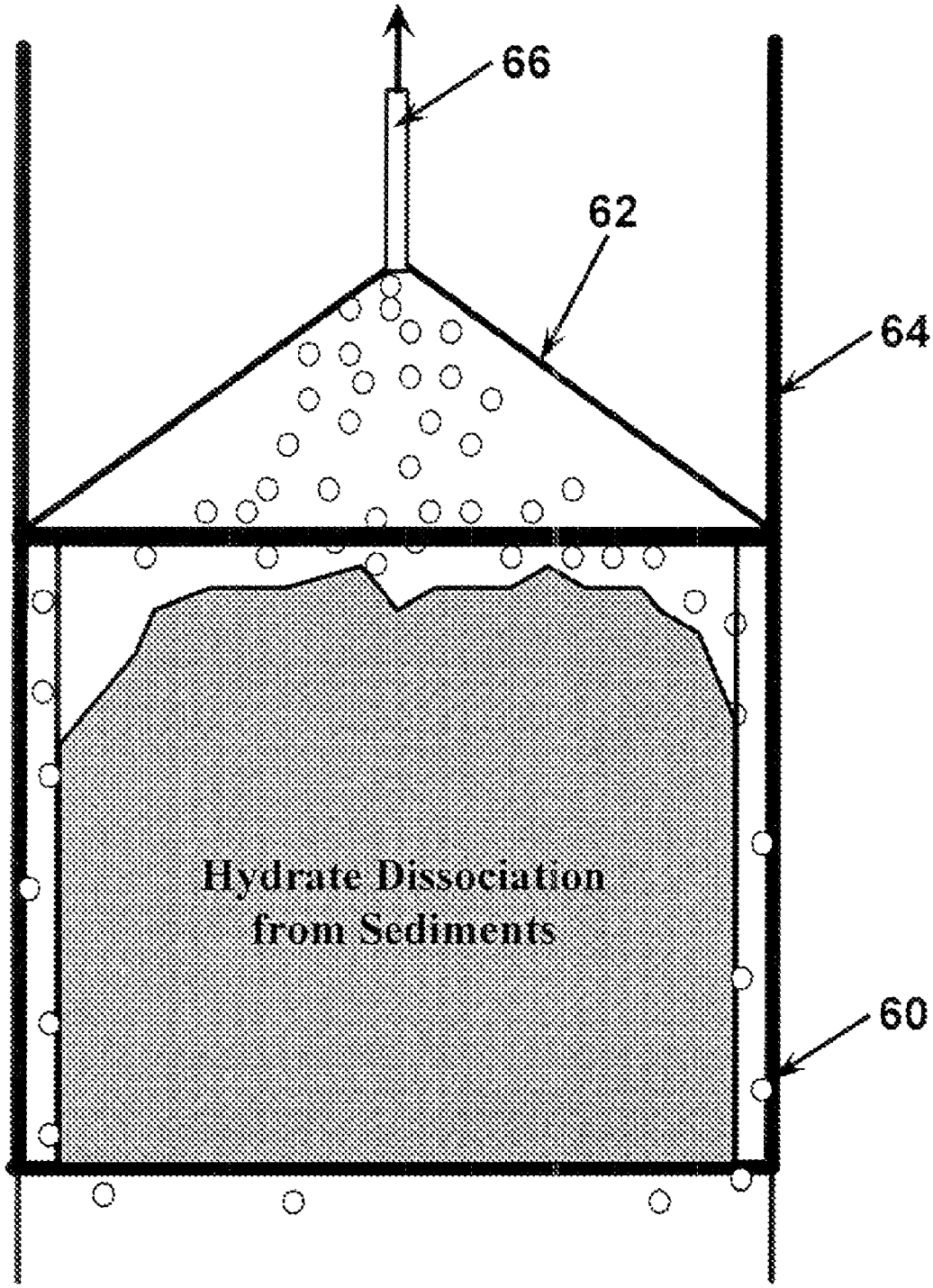
FIGS. 6 and 7 illustrate diagrammatic views of an alternate, preferred embodiment of the present invention.
Figure 7:
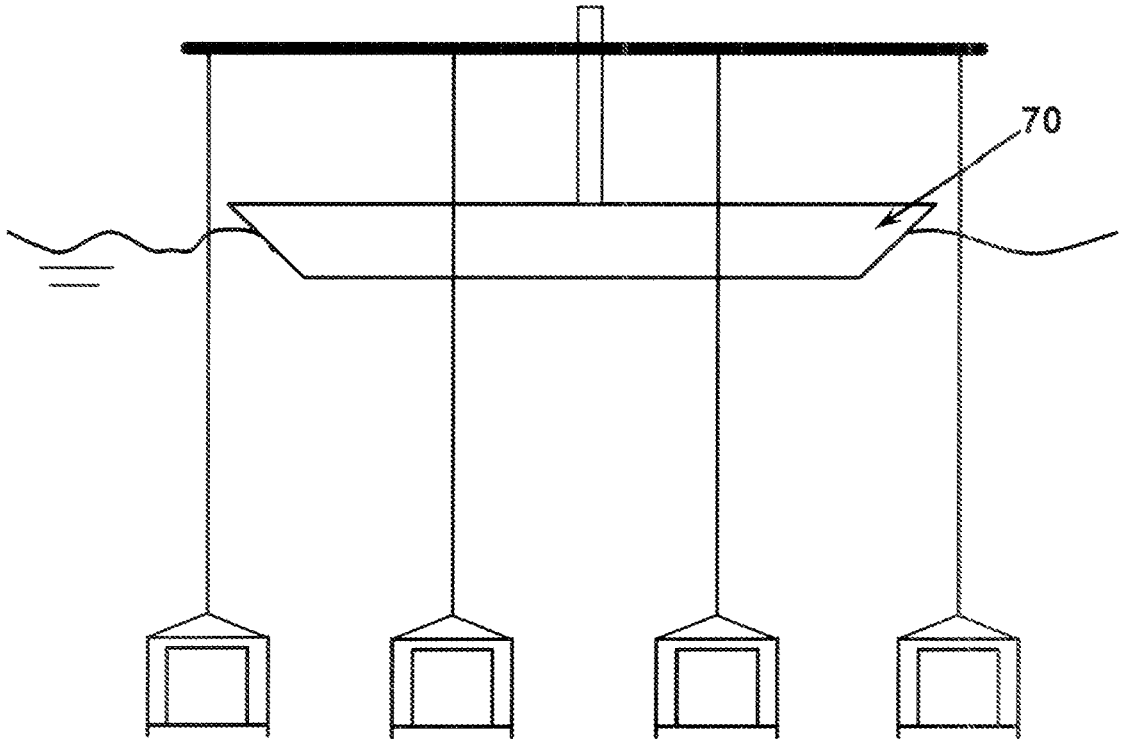

A further alternate embodiment process is illustrated in FIGS. 6 and 7. This method is to directly lift sea floor sediments to a certain desired level where the seawater pressure is lower and the temperature is higher than the local HFT. It is suitable for producing hydrocarbon gas from the hydrate sediments close to the sea floor surface (sometimes referred to as skin). Using known sea floor mining methods, the hydrate rich sediments can be loaded into a container 60. Then, the container is covered with an overhead receiver 62 (as shown in FIG. 6) and lifted by cables 64 towards a floating vessel. Hydrates begin to dissociate and gas is released when the seawater temperature is higher than the local HFT. The gases flow upward and are collected with a pipe or fluid line 66 connected to the top of the overhead receiver 62.

One floating vessel 70 can lift many containers and produce gas simultaneously as shown in FIG. 7. A deployed load will thereafter be returned to the sea floor. It is slightly heavier than a same size fresh load due to the density difference between hydrates and seawater. It can serve as a counter weight to lift a new load up. Therefore, very little power is required using this method.

A non-limiting example of the foregoing process would utilize sea bed mining methods that are known to partition marine sediments into segments in order to load them into a container, for example a 30×30×30 cubic feet load or block. The weight of such a block or partition might be about 1,000 tons in sea water. The block or load would be placed in a container 60 covered with an overhead receiver or a hood. The container 60 would have a base or alternatively, a base would be moved into place under the load. The container 60 with accompanying overhead receiver 62 would thereafter be lifted up to a shallower depth where the pressure was lower and the temperature higher which would be suitable for hydrate dissociation.

The dissociation rate could be controlled by controlling the sea depth of the load. The hydrocarbon gas released would be collected at the top of the overhead receiver 62 and thereafter delivered through a valve and a pipe, tube, or fluid line 66 to the floating vessel 70. The gas at the vessel could be compressed for further transportation. Assuming a 10% hydrate concentration, one load of sediments might contain 2,700 cubic feet of hydrates in order to produce 0.5 million set of natural gas.

After the hydrocarbon gas is released from one load, the depleted sediment could be returned to an alternate location on the sea floor. The depleted load could also be used as a counterweight to lift a new load. Accordingly, energy could be saved in this manner. One production vessel could lift and lower multiple units in order to produce gas on a continuous basis. Assuming that 50 loads could be raised daily, approximately 25 million of scf of natural gas could be produced per day.

Whereas, the present invention has been described in relation to the drawings attached hereto, it should be understood that other and further modification, apart from those shown or suggested herein, may be made within the spirit and scope of this invention.

What is claimed is:

1. A process for extracting hydrocarbon gases from marine sediment hydrates, which process comprises:

drilling a well from a sea floor into a hydrate rich subsea sediment to form at least one opening therein;

inserting electrical heaters into said hydrate rich subsea sediment through said well into at least one opening;

heating said hydrate rich subsea sediment with said electrical heaters in order to release hydrocarbon gas therefrom;

allowing said hydrocarbon gas to form hydrates again through cold seawater;

collecting said re-formed hydrates in an overhead receiver open to said sea water;

raising said overhead receiver with said re-formed hydrates therein to a sea depth where pressure and temperature permit dissociation of said accumulated hydrates into hydrocarbon gas; and gathering said hydrocarbon gas from a top of said overhead receiver.

2. A process as set forth in claim 1 including the additional step of delivering said hydrocarbon gas from said top of said overhead receiver to a vessel at sea level.

3. A process as set forth in claim 1 wherein said at least one opening includes a primary well and a plurality of small radial wells at an angle to said primary well.

4. A process as set forth in claim 1 wherein said electrical heaters are resistance heaters connected by cable to an electrical power supply or to electrical generators at sea surface level.

5. A process as set forth in claim 1 wherein said at least one opening is drilled as a continuation of said well or drilled at a downward angle.

6. A process for extracting hydrocarbon gases from marine sediment hydrates, which process comprises:

drilling a well from a sea floor into a hydrate rich subsea sediment to form at least one opening therein including a primary well;

inserting electrical resistance heaters into said hydrate rich subsea sediment through said well into at least one opening, wherein said heaters are connected by cable to an electrical power supply or to electrical generators at sea surface level;

heating said hydrate rich subsea sediment with said electrical heaters in order to release hydrocarbon gas therefrom;

allowing said hydrocarbon gas to flow through said well into an overhead receiver, wherein said hydrocarbon gas forms hydrates again through cold seawater;

collecting said re-formed hydrates in said overhead receiver open to sea water;

raising said overhead receiver with said re-formed hydrates herein to a sea depth where pressure and temperature permit dissociation of said accumulated hydrates into hydrocarbon gas;

gathering said hydrocarbon gas from a top of said overhead receiver; and delivering said hydrocarbon gas from said top of said overhead receiver to a vessel at sea level.

* * * * *